US008613819B2

(12) United States Patent
Vehof

(10) Patent No.: US 8,613,819 B2
(45) Date of Patent: Dec. 24, 2013

(54) METHOD FOR PRODUCING QUENCHED COMPONENTS CONSISTING OF SHEET STEEL

(75) Inventor: Robert Vehof, Amersfoort (NL)

(73) Assignee: voestalpine Metal Forming GmbH, Krems an der Donau (AT)

( * ) Notice: Subject to any disclaimer, the term of this patent is extended or adjusted under 35 U.S.C. 154(b) by 944 days.

(21) Appl. No.: 11/659,148

(22) PCT Filed: Aug. 9, 2005

(86) PCT No.: PCT/EP2005/008641
§ 371 (c)(1),
(2), (4) Date: Oct. 14, 2008

(87) PCT Pub. No.: WO2006/015849
PCT Pub. Date: Feb. 16, 2006

(65) Prior Publication Data

US 2009/0211669 A1 Aug. 27, 2009

(30) Foreign Application Priority Data

Aug. 9, 2004 (DE) ..... 10 2004 038 626

(51) Int. Cl.
*C21D 8/00* (2006.01)
*C22C 38/00* (2006.01)
*B21D 11/02* (2006.01)

(52) U.S. Cl.
USPC ..... 148/654; 148/320; 72/296

(58) Field of Classification Search
USPC ..... 148/654, 320; 72/296
See application file for complete search history.

(56) References Cited

U.S. PATENT DOCUMENTS

| | | | | |
|---|---|---|---|---|
| 5,100,482 | A * | 3/1992 | Tanaka et al. | 148/653 |
| 6,564,604 | B2 | 5/2003 | Kefferstein et al. | |
| 6,874,346 | B1 * | 4/2005 | Faymonville | 72/389.4 |
| 2003/0066582 | A1 * | 4/2003 | Gehringhoff et al. | 148/648 |

FOREIGN PATENT DOCUMENTS

| | | |
|---|---|---|
| DE | 2 003 306 | 7/1970 |
| DE | 43 31 176 | 3/1994 |
| DE | 197 23 655 | 12/1997 |
| DE | 100 49 660 | 4/2002 |

(Continued)

OTHER PUBLICATIONS

Machine translation of EP 1300475.*

*Primary Examiner* — Rebecca Lee
(74) *Attorney, Agent, or Firm* — Setter Roche LLP

(57) ABSTRACT

The invention relates to a method for producing quenched components consisting of sheet steel, comprising the following steps: a) shaped parts are formed from sheet steel; b) the end of the shaped part is cut and the sheet steel is optionally punched or provided with a desired hole pattern prior to, during, or after the forming of the shaped part; c) at least some sections of the shaped part are subsequently heated to a temperature that permits the steel material to austenitize; and d) the component is then transferred to a quenching die, where it is subjected to a quenching process, during which the component is cooled and thus quenched by the contact of the quenching die with some sections of the component and the compression of said sections. The invention is characterized in that the component is supported by the quenching die in the vicinity of the positive radii and that some sections of said component are clamped in a secure manner without distortion in the vicinity of the cut edges. In the sections of the component that are not clamped, the latter is separated from a quenching-die half by a gap.

21 Claims, 8 Drawing Sheets

(56) References Cited

FOREIGN PATENT DOCUMENTS

| | | |
|---|---|---|
| DE | 101 20 063 | 11/2002 |
| DE | 102 54 695 | 4/2004 |
| EP | 1 013 785 | 6/2000 |
| EP | 1 253 208 | 10/2002 |
| EP | 1 300 475 | 4/2003 |
| GB | 1 490 535 | 11/1977 |
| JP | 6218451 | 8/1994 |
| JP | 2003 328031 | 11/2003 |

* cited by examiner

| | |
|---|---|
| ***Step 1:***<br>Part is cold formed and cut in the soft state. | 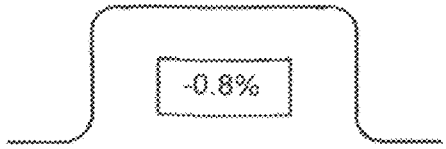 |
| ***Step 2:***<br>Part is heated to hardening temperature and inserted into the die. | 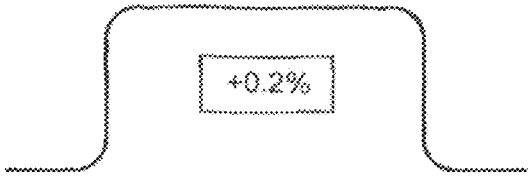 |
| ***Step 3.1:***<br>Part is secured in a clamped fashion along all cut edges | 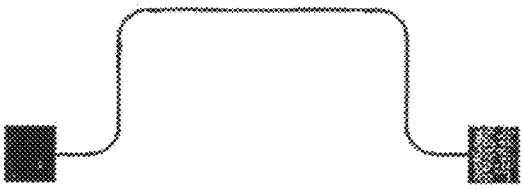 |
| ***Step 3.2:***<br>Part tries to shrink. This is why it is necessary to support the positive radii. During shrinkage, the part then automatically assumes this form.<br><br>After it is supported at the radii, the part subsequently cools to below 100°C and then stresses build up. | 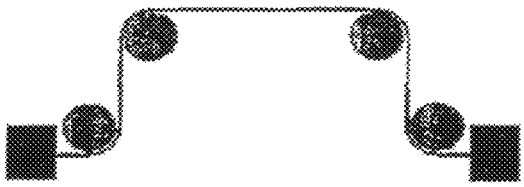 |
| ***Step 4:***<br>The elastic stresses can be reduced upon removal and the part shrinks uniformly by 0.2% | 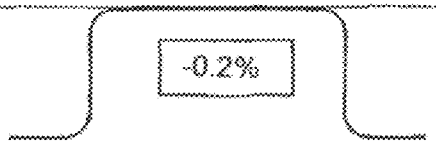 |

Fig. 9

Cutting of the forming blank

Deep-drawing (-0.80%)

Cutting away excess 1 (-0.80%)
+ cutting of (RPS-) holes

Cutting away excess 2 (-0.80%)

Form hardening (+0.20%) and
subsequent breaking-off of tabs;
After removal, yields finished part 0%

| Series Process: | |
|---|---|
| 1. cutting of plates | 6. cleaning |
| 2. cold forming: drawing | 7. quality control & storage |
| 3. mechanical cutting | ➢ volumetric analysis |
| 4. heating | ➢ mechanical properties |
| 5. form hardening | ➢ corrosion properties |

METHOD FOR PRODUCING QUENCHED COMPONENTS CONSISTING OF SHEET STEEL

FIELD OF THE INVENTION

The invention relates to a method for manufacturing hardened components out of sheet steel, a device for executing the method, and hardened components made of sheet steel that are manufactured using the method and the device.

BACKGROUND OF THE INVENTION

In the field of automotive engineering, there is an ongoing quest to reduce total vehicle weight or to add improved equipment without increasing total vehicle weight. This can only be achieved by reducing the weight of certain vehicle components. In this connection, there is particular impetus to reduce the weight of the vehicle body significantly in comparison to prior designs. At the same time, however, there are increased demands relating to safety, in particular safety to persons traveling in the vehicle, and relating to the behavior of the vehicle in an accident. While the number of parts and in particular also the thickness of parts are reduced in order to reduce the gross weight of the body, the reduced-weight body shell is expected to have an increased strength and rigidity with a definite deformation behavior in the event of an accident.

The raw material most frequently used in body manufacture is steel. No other material is able to provide so many sectors with inexpensive components that boast such a wide variety of material properties.

As a result of the changed requirements, at high strengths, high expansion factors are also assured and along with them, an improved cold formability. In addition, the range of achievable strengths for steels has been increased.

One example of this, particularly for automotive bodies, is components comprised of sheet steel with a strength—depending on the alloy composition—in a range from 1000 to 2000 MPa. In order to achieve such high strengths in the component, it is known to cut corresponding blanks from sheets, to heat the blanks to a temperature higher than the austenitizing temperature, and then to form the component in a press; during the forming process, a rapid cooling is simultaneously executed in order to harden the material.

During the annealing that is carried out in order to austenitize the plates, a scale layer forms on the surface. This is descaled after the forming and cooling. Usually sandblasting processes are used for this. Before or after this descaling, the final trimming and introduction of holes are carried out. If the final trimming and introduction of holes are carried out before the sandblasting, then this can have a disadvantageous effect on the cut edges and hole edges. Independent of the sequence of processing steps after the hardening, descaling by means of sandblasting and comparable methods has the disadvantage that this frequently distorts the component. After the above-mentioned processing steps, a so-called component coating with a corrosion protection layer is carried out. For example, a cathodic corrosion protection layer is applied.

In this context, it is disadvantageous that the remachining of the hardened component is extraordinarily expensive and involves a very high degree of wear due to the hardening of the component. It is also disadvantageous that the component coating usually does not produce a particularly pronounced corrosion protection. In addition, the layer thicknesses are not uniform, but instead fluctuate over the surface of the component.

In a modification of this method, it is also known to cold form a component out of a sheet metal blank, to subsequently heat it to the austenitizing temperature, and then to rapidly cool it in a calibration tool. The component, which experiences distortion due to the heating, is calibrated by the calibration tool in its formed regions. Then, the above-described remachining is carried out. This method enables the production of more complex geometries than the method described previously because simultaneous forming and hardening is essentially only able to produce linear forms, but such shaping procedures are unable to produce complex forms.

GB 1 490 535 has disclosed a method for manufacturing a hardened steel component in which a plate of hardenable steel is heated to the hardening temperature and then placed into a forming device in which the plate is formed into the desired final form and during the forming, is rapidly cooled at the same time so that a martensitic or bainitic structure is obtained while the sheet remains in the forming device. For example, a boron-alloyed carbon steel or carbon manganese steel is used as the base material. According to the patent application mentioned above, the forming is preferably a pressing, but can also be used with other methods. The forming and cooling should preferably be designed and rapidly executed so as to obtain a fine-grained martensitic or bainitic structure.

EP 1 253 208 A1 has disclosed a method for manufacturing a hardened plate profile from a plate that is hot formed and hardened in a pressing die to form a plate profile. On the plate profile, reference points or collars that protrude up from the plane of the blank are produced, which are used for positioning the plate profile in subsequent production operations. During the forming process, the collars should be formed out of unperforated regions of the blank; the reference points are produced in the form of stamped regions at the edges or in the form of punch-through points or collars within the outline of the plate profile. The hot forming and hardening in the pressing die should generally be advantageous due to the efficient operation achieved by the combination of the forming and the hardening/tempering procedure in a die. But the clamping of the plate profile in the die and the thermal stresses end up producing distortion in the component that cannot be exactly predetermined. This can have a negative impact on the subsequent production operations, which is why the reference points are produced on the plate profile.

DE 197 23 655 A1 has disclosed a method for manufacturing sheet steel products in which a sheet steel product is formed in a pair of cooled dies while it is hot and is hardened into a martensitic structure while it is still in the die so that the dies function as immobilizing means during the hardening. In the regions in which a machining is to take place after the hardening, the steel should be kept in the mild steel range; inserts in the dies are used to prevent a rapid cooling and therefore a martensitic structure in these regions. It should also be possible to achieve the same effect by means of recesses in the dies so that a gap forms between the steel plate and the dies. This method has the disadvantage that due to the considerable amount of distortion that can occur in it, the method in question is unsuitable for press hardening components with a more complex structure.

DE 100 49 660 A1 has disclosed a method for manufacturing locally reinforced formed sheet metal parts; the base plate of the structural part, when flat, is attached to the reinforcing plate in a definite position and this so-called patched composite plate is then formed as a unit. In order to improve the manufacturing method with regard to method creation and the results achieved and in order to relieve stress on the mechanisms executing the method, the patched composite plate is heated to at least approximately 800 to 850° C. before the forming, is rapidly inserted, quickly formed in the hot state, and then cooled in a definite way through contact with the blower-cooled forming die while the formed state is mechanically maintained. Particularly the temperature range of 800 to 500° C., which is decisive in this regard, should be passed through at a definite cooling speed. The step of joining the reinforcing plate to the base plate should be easy to integrate into the forming process; the parts are hard soldered to each other, which can simultaneously produce an effective corrosion protection in the contact zone. This method has the disadvantage that the defined internal cooling renders the dies very complex.

DE 2 003 306 has disclosed a method and device for pressing and hardening a steel component. The object is to press and harden pieces of plate steel in a die, with the intent of avoiding the disadvantages of prior processes, in particular that parts made of sheet steel are manufactured in successive, separate steps for form pressing and hardening. In particular, the intent is to prevent the hardened or quenched articles from deforming in relation to the desired form and thus necessitating additional work steps. To achieve this, a steel piece, after having been heated to a temperature that induces its austenitic state, is placed between a pair of cooperating die elements, whereupon the piece is pressed and at the same time, heat is rapidly dissipated from the piece into the die parts. The die parts are kept at a cool temperature during the entire process so that a quenching action is exerted on the piece while it is subjected to a die pressure.

DE 101 20 063 C2 has disclosed supplying metallic profile motor vehicle components, which are made of a base material supplied in belt form, to a profile rolling unit and rolling them into a rolled profile; after emerging from the profile rolling unit, some regions of the rolled profile are inductively heated to a temperature required for the hardening and then quenched in a cooling unit. After this, the rolled profiles should be cut to the length to form the profile components.

U.S. Pat. No. 6,564,604 B2 has disclosed a process for manufacturing a part with very high mechanical properties in which the part is to be manufactured by stamping a strip out of a rolled steel sheet and in particular, a hot rolled and coated component is coated with a metal or metal alloy intended to protect the surface of the steel and in which the steel sheet is cut to obtain a sheet steel blank; the sheet steel blank is hot formed or cold formed and either cooled and hardened after the hot forming or heated and then cooled after the cold forming. An intermetallic alloy should be deposited onto the surface before or after the forming and should offer a protection against corrosion and decarburization of the steel; this intermetallic mixture can also perform a lubricating function. The excess material is then removed from the blank. The coating here should generally be based on zinc or a zinc-aluminum alloy.

EP 1 013 785 A1 has disclosed a manufacturing process for a component made of rolled steel band, in particular a hot rolled band. The object is to be able to supply rolled steel sheets 0.2 to 2.0 mm thick, which, among other things, are coated after the hot rolling and are subjected to either a hot or cold deformation, followed by a thermal treatment in which the intent is to assure—before, during, and after the hot forming or the thermal treatment—the increase in the temperature without decarburization of the steel and without oxidation of the surface of the above-mentioned sheets. To this end, the sheet is provided with a metal or metal alloy that assures protection of the surface of the sheet, then the sheet is subjected to a temperature increase for the forming, whereupon a forming of the sheet is carried out and the part is then cooled. In particular, the coated sheet should be pressed in the hot state and the part produced by means of deep-drawing should be cooled for hardening purposes, in fact at a speed that is greater than the critical hardening speed. The application cited above also discloses a steel alloy that ought to be suitable, the intent being to austenitize this steel plate at 950° C. before it is deformed and hardened in the die. The coating applied should in particular be comprised of aluminum or an aluminum alloy; this should provide not only an oxidation and decarburization protection, but also a lubricating action. By contrast with the other known methods, this method does in fact make it possible to prevent scale from forming on the sheet metal part after it has been heated to the austenitizing temperature, but a cold forming of the kind discussed in the application mentioned above is essentially impossible with fire-aluminized sheets because the fire-aluminized layer has too low a ductility to permit a greater deformation. Particularly deep-drawing processes for more complex forms cannot be achieved with sheets of this kind when cold. With a coating of this kind, hot forming procedures, i.e. forming and hardening in a single die, are possible, but the component does not have any cathodic protection afterward. In addition, such a component must be machined mechanically or by laser after hardening, thus involving the previously described disadvantage that subsequent machining steps are very expensive due to the hardness of the material. It is also disadvantageous that all of the regions of the formed part that are cut mechanically or by laser no longer have any corrosion protection whatsoever.

From DE 102 54 695 B3, it is known to manufacture a metallic formed component—in particular a body component comprised of a semifinished product that is composed of an unhardened, hot formable steel sheet—by first forming the semifinished product by means of a cold forming process, in particular by means of deep-drawing. Then, the edges of the component blank are cut along an outer contour that approximately corresponds to that of the component to be manufactured. Finally, the cut component blank is heated and press-hardened in a hot forming die. The component produced in this manner has the desired outer contour immediately after the hot forming, thus making it unnecessary to subsequently trim the component edge. This should significantly reduce the cycle times in the manufacture of hardened components of sheet steel. The steel used should be an air-hardened steel that is heated under the protection, as needed, of a protective gas atmosphere in order to avoid scale formation during the heating. Otherwise, a scale layer on the formed component is descaled after the hot forming of the component. The patent application cited above mentions the fact that in the course of the cold forming process, the component blank comes out of the die in a form close to the final contour; the expression "close to the final contour" is intended to signify that the parts of the geometry of the finished component that are accompanied by a macroscopic material flow are completely formed into the component blank after the end of the cold forming process. After the end of the cold forming process, producing the three-dimensional form of the component should require only slight adaptations in shape, which require a minimum of local material flow. This method has the disadvantage that as before, a final forming step of the overall contour still occurs in the hot state and in order to avoid the formation of scale, either the known approach must be taken, which involves annealing in an envelope of protective gas, or the parts must be descaled. Both processes must be followed by a subsequent provision of a corrosion protection coating.

In summary, it is clear that all of the above-mentioned methods share the disadvantage that in order to achieve an optimal cooling action and to avoid distortion, steps are taken to achieve a 100% contact of the formed parts against the dies (a so-called 100% marking image).

Such a marking image requires a long, very labor-intensive breaking-in of the die in which applied ink is used to indicate which regions of the component are not yet resting against the die over their entire surface. Correspondingly, the surface must be continuously corrected. In spite of this fact, all known press hardening processes share the trait that despite careful breaking-in, distortion and cut edge displacement occur frequently and in an unpredictable fashion so that particularly after coming out of the die, components are distorted and the cut edges become displaced. Because of the high degree of hardness, such parts can no longer be remachined and for example straightened. In the known methods, the remachining is limited to the final trimming by laser.

One object of the present invention is to create a method for manufacturing hardened components comprised of sheet steel, which sharply curtails the break-in time of dies, reduces die wear, and supplies distortion-free, reliable components with a high degree of dimensional accuracy and fit, making it possible to omit remachining of the work pieces.

Another object is to create a device for manufacturing hardened components comprised of sheet steel, which has a reduced break-in time, is less susceptible to wear, is quicker to repair, and supplies distortion-free, reliable components with a high degree of dimensional accuracy and fit.

SUMMARY OF THE INVENTION

The present invention is based on the recognition that a main problem in press hardening lies in the fact that when breaking in the dies using preformed and in particular deep-drawn steel sheets, the die is broken in on the sheets and a contact with these sheets is produced over almost their entire area. But the preformed and in particular deep-drawn steel sheets with which the hardening dies are broken in are also steel sheets that are manufactured with new forming dies, which are themselves also in the break-in stage. But an actual contact of the entire area of the die halves with the work piece is practically never achieved, on the one hand due to die wear in both the deep-drawing die and the hardening die and on the other hand, due to thickness tolerances of the supplied sheet steel or differences in the thickness of the material due to the cold forming, the so-called material extraction. But this also means that in some locations, the work piece is pressed with a very powerful force and in other locations, is pressed with hardly any force at all. Between these two extremes, the sheet can be clamped at a wide variety of locations with forces that lie between the maximum force and an almost nonexistent force. These locations, in which clamping occurs with maximum force, minimum force, or forces somewhere between them, cannot be predicted. They are, however, frequently also situated in the flange region.

The invention has made it possible to determine that this results in the inevitable shrinkage of the component being prevented in the regions in which it is powerfully clamped and, in the regions in which the clamping is weaker, a shrinkage occurs with more or less no predictability as to the intensity. As a result, different material properties and formed part properties, in particular different stress states and shrinkages, are generated. These result in a shifting and in particular a twisting of the components. It has also been possible to determine that the phase conversion from austenite to martensite contributes in a not insignificant way to the occurrence of this shrinkage in a nonlinear fashion with the temperature, which further complicates corresponding considerations.

In the method according to the invention, the preformed and in particular deep-drawn components are heated to the temperature required for hardening and then transferred to a die. According to the invention, the approach of aiming for the greatest possible area of clamping or pressing is abandoned and a partial-area pressing is intentionally carried out. As a result, reliable clamping and holding can be achieved in regions in which the clamping occurs with a very powerful pressure. But this preferably occurs with a high enough local pressure to displace and more or less forge material, surface irregularities, or local excesses. As a result of this, the material works easily into the surface of the die so that the friction between the die and the material increases. The material is thus set to a uniform maximum thickness in the pressed region. The total required forming pressure of the press, however, can be lower than with full surface methods, thus permitting the use of significantly less expensive presses. In this case, the component is held in a clamped fashion at least in the region of the cut edges. In the context of the invention, the term "cut edges" applies to outer edges and to holes or their edges.

In addition, the component can also intentionally be clamped over its length or area. To this end, the clamped regions can extend in linear fashion or in a grid pattern over the entire area or partial areas of the work piece. As a result, in the pressed regions, the component can be embodied with hardness regions or hardness curves that are adapted to the best possible crash behavior. For example, the pressing can be carried out along the principal stress lines or lines of flux, thus supplying these regions with a higher degree of hardness. This pressing or clamping can also prevent a deformation-induced twisting, particularly when the work piece is being removed from the die. The unpressed regions, which have a lower strength, possibly due to a lower cooling rate, can constitute a deformation reserve of the component so that when stress is exerted on a hardened component, it does not break—as is otherwise usually the case with homogeneously hardened or press-hardened components—but instead is still able to deform somewhat. This prevents the component from detaching in the event of an accident.

In the regions in which the component is not pressed, it either rests against one die half on one side and is spaced slightly apart from the other die half by an air gap or is spaced apart from both die halves with an air gap.

According to the present invention, in the regions in which no pressing occurs, the component is supported at least in the vicinity of the positive radii by regions of the die or the die halves. In the regions of saddle points that have a narrow radius of for example 0.5 to 30 mm, the work piece is advantageously pressed or clamped. In this case, saddle points are defined so that in the region of a saddle point or saddle region, the work piece has a positive radius with regard to two spatial axes.

This also means that in the region of a positive radius, the work piece rests against only one die half, but not against the opposing die half. It has surprisingly turned out that with an air gap of this kind and with the correct adjustment according to the invention, it is possible to positively influence and in particular control the cooling and therefore the hardening. According to the invention, the air gap can also be set so that in preselected regions, the component is hardened less than in other regions. This can be useful, for example, if certain zones of such a component should have a reduced hardness and therefore still have the capacity to deform. Furthermore, a so-called "zone with less hardness" can be avoided through a reduced hardness of the base material. According to the invention, the air gap or gaps is/are embodied with a width of at least 0.02 mm and preferably 0.1 to 2.5 mm or greater.

According to the invention, the forming of the components and the trimming and perforation of the components are carried out essentially or completely in the unhardened state. The relatively good deforming capacity in the unhardened state of the sheet material used makes it possible to achieve more complex component geometries and replaces an expensive subsequent trimming in the hardened state with significantly less expensive mechanical cutting operations before the hardening process.

In the regions in which the work piece is clamped, however, a cutting operation within the clamped region, for example the production of a hole or recess, i.e. inside the sheet, or the cutting-off of a part or of the entire outer contour can occur in the hot state. For the cutting inside the sheet, the clamping regions of the die halves are provided with corresponding recesses, which accommodate the cutting tool. For the cutting of the contour, a cutting tool is provided adjacent to, but outside the clamping region. The hot cutting preferably occurs at component temperatures of between 380° C. and 800° C. As a result, the regions that should shrink freely are not influenced or impeded in any way.

The inevitable dimensional changes brought on by the heating of the component are taken into account in the forming of the cold sheet so that the component is manufactured to be approximately 0.6 to 1.0% smaller and in particular 0.8% smaller than the final dimensions. At the very least, the expected thermal expansion during the forming is taken into account. Aside from the reduced size, though, the component is formed and trimmed in a completely precise fashion with respect to the final contour.

According to another embodiment of the method, in the cold machining of the component, i.e. the forming, cutting, and perforation, it can be sufficient for only the regions with a high complexity and forming depth and possibly the tightly toleranced regions of the component, in particular the cut edges, formed edges, formed surfaces, and possibly the pattern of holes, in particular the reference holes, to be manufactured with the desired final tolerances, in particular the trimming and position tolerances of the finished, hardened component; in so doing, the thermal expansion of the component due to the heating should be taken into account and compensated for.

This means that in the first embodiment, after the cold forming, the component is approximately 0.8% smaller than the desired final dimensions of the finished, hardened component. In this context, "smaller" means that after the cold forming, the formation of the component is complete in all three spatial axes, i.e. three-dimensionally. The thermal expansion is thus taken into account in equal measure for all three spatial axes. In the prior art, the thermal expansion, for example due to the incomplete closing of the die, could not be taken into account for all of the spatial axes since in this case, it was only possible to take into account an expansion in the Z direction due to an incomplete removal from the die. According to the present invention, the three-dimensional geometry or contour of the die is preferably produced to be smaller in all three spatial axes.

To carry out the method, the unhardened, galvanized special thin sheet is first cut into blanks.

The prepared blanks can be rectangular, trapezoidal, or formed blanks. All known cutting processes can be used for the cutting of the blanks. Preferably, cutting processes are used, which do not introduce so much heat into the plate during the cutting process that a hardening occurs.

Then, cold forming dies produce formed parts from the cut blanks. This production of formed parts includes all methods and/or processes that are capable of producing these formed parts. For example, the following methods and/or processes are suitable:

sequential compound dies,
concatenations of individual dies,
graduating dies,
hydraulic press lines
mechanical press lines
explosive forming, electromagnetic forming, tubular hydroforming, blank hydroforming,
and all cold forming processes.

With the conventional dies mentioned above, the final trimming takes place after the forming and particularly after the deep-drawing.

According to the invention, the formed part that has been formed in the cold state is manufactured to be approximately 0.8% smaller than the geometry of the final component, thus compensating for the thermal expansion during heating.

The formed parts manufactured by the above-mentioned processes should be cold formed, with dimensions within the tolerance range that is required for the finished part by the customer. If greater tolerances occur in the above-mentioned cold forming, these can later be partially corrected to an extremely slight degree during the form hardening process, as will be discussed in detail below. The tolerance correction in the form hardening process, however, is preferably carried out only for form errors. Such form errors can thus be corrected after the fashion of a hot calibration. The correction process, however, should if possible be limited solely to a bending process; cut edges that depend on the material quantity should not and cannot be influenced after the fact (in relation to the form edge), i.e. if the geometry of the cut edges in the parts is not correct, then no correction can be carried out in the form hardening die. In summary, it is therefore clear that the tolerance range with regard to the cut edges corresponds to the tolerance range during the cold forming and form hardening process.

In an advantageous embodiment of the method according to the invention, during the forming in the cold state, i.e. during the deep-drawing, for example, a flange is produced in an intrinsically known fashion adjacent to the cold-preformed component and in the vicinity of the cut edge. After the formation of the flange, the outer trimming in the region of the flange is carried out. This has the advantage that this cut is produced parallel to the opening and closing direction of the press die. Even in components in which a flange is not actually desired, it can nevertheless be advantageous to produce this flange in the cold state for purposes of the above-mentioned cutting. The flange is then subsequently removed in the course of the form hardening process, as will be described further below.

After the component has been completely formed, the formed, trimmed part is heated to an annealing temperature above 780° C., in particular 800° C. to 950° C. and is kept at this temperature for a few seconds to a few minutes, but at least until a desired austenitization has taken place. In the process of this, the component expands by 1% so that after the annealing and shortly before insertion, it is oversized by 0.2%.

After the annealing process, the component is subjected to the form hardening step according to the invention.

The heating and form hardening will be described below by way of example.

For the execution of the form hardening process, in particular, a part is first taken from a conveyor belt by a robot and inserted into a marking station so that each part can be comprehensibly marked before the form hardening. Then the robot places the part on an intermediate carrier, the intermediate carrier travels by conveyor belt into a furnace, and the part is heated.

For example, a continuous furnace with convection heating is used for the heating process. But any other kind of heating unit or furnace can be used, particularly furnaces in which the formed parts are heated electromagnetically or with microwaves. The formed part travels through the furnace on the intermediate carrier; the intermediate carrier is provided to prevent the corrosion protection layer from being transferred to the rollers of the continuous furnace or being abraded by them during heating.

In the furnace, the parts are heated to a temperature greater than the austenitizing temperature of the alloy used.

After the parts are heated to the maximum temperature, in order to achieve a complete hardening, a cooling from a certain minimum temperature (>700° C.) must be carried out at a minimum cooling speed of >20K/s. This cooling speed is achieved in the subsequent form hardening.

To execute this, a robot takes the part out of the furnace at 780° C. to 950° C., in particular 860° C. to 900° C., also depending on the thickness, and places it into the form hardening die. During the manipulation or handling, the formed part loses approximately 10° C. to 80° C., in particular 40° C.; the robot for the insertion is preferably designed so that it inserts the part at a high speed into the form hardening die in a dimensionally accurate fashion. The robot places the formed part onto a part lifter and the press is rapidly lowered, displacing the part lifter and immobilizing the part. This assures that the component is perfectly positioned and guided until the die is closed. In the moment at which the press and therefore the form hardening die is closed, the part still has a temperature of at least 780° C. The surface of the die has a temperature of less than 50° C., as a result of which the part is rapidly cooled to 80° C. to 200° C. After completion of the austenite/martensite conversion, i.e. below 250° C., the component can already be removed. This saves time in comparison to the prior art. Naturally, the part can also remain in the die for further cooling. During the hardening, the air gaps can be flushed with gas, in particular inert gases. If need be, the gases can exert a cooling action.

This subjects the die to thermal shock in the locations at which it rests against the work piece; the method according to the invention makes it possible—particularly when no forming steps are carried out during the form hardening step—to design the die, with respect to its base material, to have a high thermal shock resistance. With conventional methods, the dies must also have a high abrasion resistance, which is not an issue in the current instance and therefore makes the die that much less expensive.

During insertion of the formed part, care must be taken that the trimmed and perforated part is inserted in a correctly fitted fashion into the form hardening die. Angles can be corrected by a simple bending, but no excess material can be eliminated. For this reason, the cut edges of the cold-formed part must be cut in a dimensionally accurate manner in relation to the die edges. The trimmed edges should be immobilized during the form hardening in order to prevent the cut edges from shifting.

In another advantageous embodiment of the method, an additional hot forming can take place, particularly in the region of the cut edges. As has been described above, during the cold forming of the component, it can be advantageous to provide the region of the cut edge with a flange that should not actually be present in the finished component. Forming such a flange in the deep-drawing process makes it possible to execute the cut perpendicular to the opening and closing direction of the die, thus permitting a particularly exact, precise, and simple cut. During the form hardening process, on the hot component, which has been inserted into the form, this formed flange is correspondingly reshaped or laid against the die when the die is closed, without stretching the material. To this end, in the region in which the flange is present, a slider is correspondingly provided; the die for the form hardening process is initially closed until the component, for example in a particular region, is held by the top part of the die and then the sliders are moved inward and press the flange against the die on which the component rests. Since the component is clamped anyway in the region of the cut edges, the sliders perform the function of the clamping in this region; the clamping and/or the subsequent forced shrinkage surprisingly succeed in achieving this so well that the previously existing bending edge of the flange is practically invisible or undetectable in the finished component.

It is fundamentally also possible to use this method with sliders to form or bend certain parts of the component in the hot state; a partial hot forming does not contradict the principle of the forced shrinkage.

Then, a robot takes the parts out of the press and places them on a rack where they cool further. If so desired, the cooling can be accelerated by additional blowing of air or immersion in fluids.

The form hardening according to the invention, without forming steps of any consequence and with a form-locked engagement between the die and the work piece only in the region of the cut edges with simultaneous support of the positive radii of the formed part, assures that the work piece is cooled without distortion. In conventional forming processes, a reproducible, definite cooling occurs only when the forming process has reached a point where the material is resting against both die halves or when the material immediately comes into form-locked contact with the die halves on all sides; this leads to inhomogeneities in strength. In the current case, the formed part rests against both die halves with only its cut edge regions and its positive radii rest only against one die half. This prevents the shrinkage in the vicinity of the cut edges while in the rest of the component, a shrinkage occurs, which is used so that the component comes to rest against the form and, as needed, undergoes subsequent bending. This makes it possible to even carry out subsequent correction of forming errors to have occurred in the deep-drawing.

The trimming of the finished, deep-drawn parts takes place sequentially in the usual fashion. With the invention, the component can be provided with protruding tabs for placing the component onto the part lifter. At least in the region in which they adjoin the component itself, these parts are hardened along with it. By means of a special movement sequence according to the invention, in particular of the part lifter after the hardening and before the die is opened, these tabs are simply broken off. This can assure a high degree of handling reliability and on the other hand, the tabs do not have to be cut off as was customary in the prior art.

The invention will be explained by way of an example in conjunction with the drawings.

BRIEF DESCRIPTION OF THE DRAWINGS

FIG. 9 shows a process sequence of the method according to the invention.

DETAILED DESCRIPTION OF THE PREFERRED EMBODIMENTS

Figure 1:
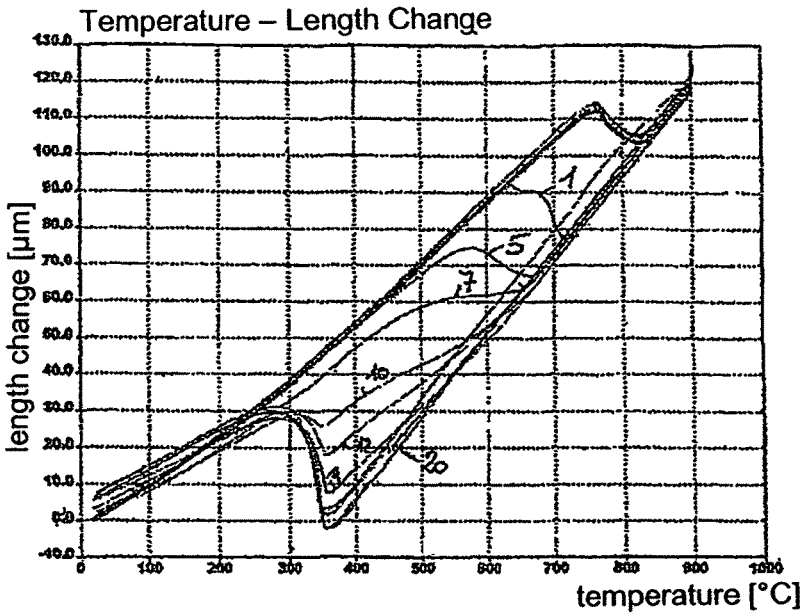
FIG. 1 is a graph depicting the dilatometer curve of a sample of a hardenable steel plate.
Figure 10:
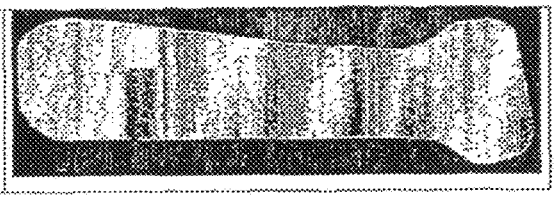
FIGS. 10-14 show the process sequence according to the invention, applied to an automotive part.
Figure 11:
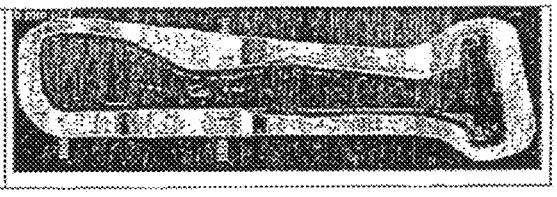

According to the invention, a component to be hardened is formed and cut in the cold state. In the cold state, i.e. before the hardening, the component has an inherent hardness that is standard for sheet steel. In this state, the plate has a reasonably good capacity for being cut, formed, and in particular deep-drawn (FIG. 10). In all three spatial axes, the component is formed to be approximately 0.8% smaller than the intended final geometry. In order to then harden the component, the component is heated to the austenitizing temperature, in particular to more than 900° C. The heating of the component here occurs in such a way that the length change of the material that is brought on by the structural change, which in turn takes place due to the austenitization, is finished (FIG. 1). It is clear from FIG. 1 that in sample components, at approximately 750° C., the initially linear thermal expansion turns downward as the temperature rises to approximately 820° C. and then begins to rise again. This irregularity in the linear expansion should be finished before the work piece is inserted into the die.

Figure 2:
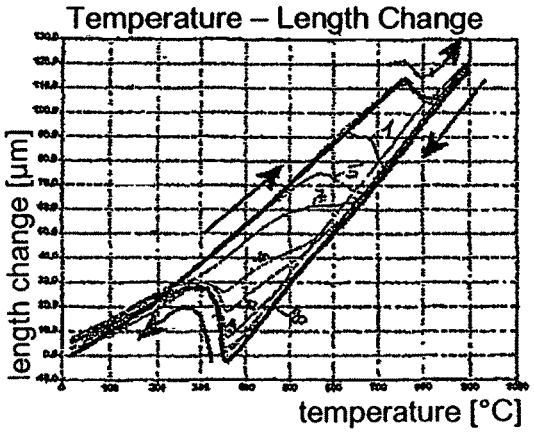
FIG. 2 shows the curve according to FIG. 1, with arrows indicating the heating and cooling.
Figure 3:
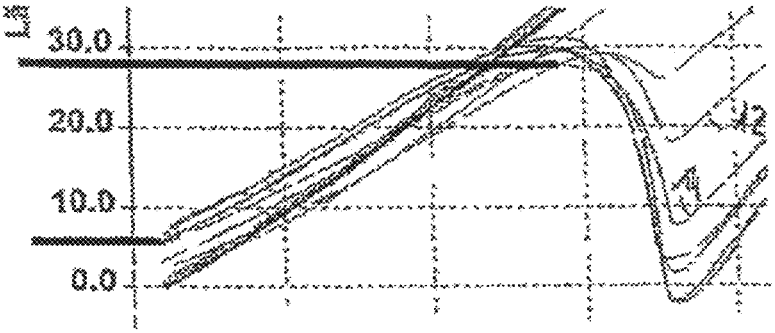
FIG. 3 shows a detail of the curve according to FIG. 2.
Figure 4:
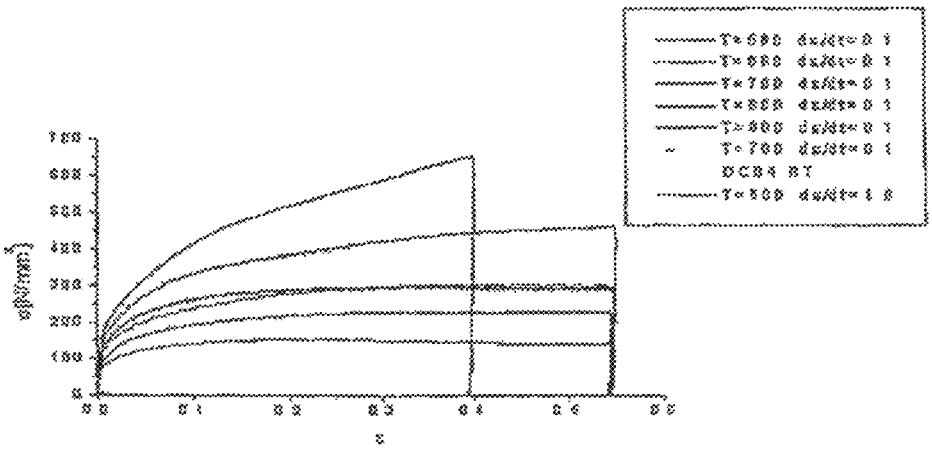
FIG. 4 shows the flow curves of a hardenable steel plate at different temperatures.
Figure 5:
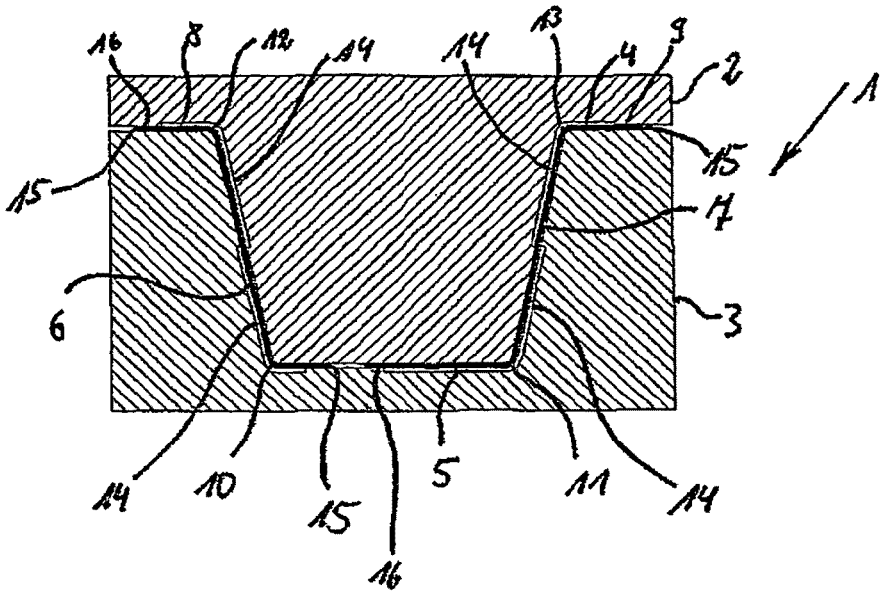
FIG. 5 is a very schematic depiction of a die set according to the invention, with a steel plate to be hardened.
Figure 6:
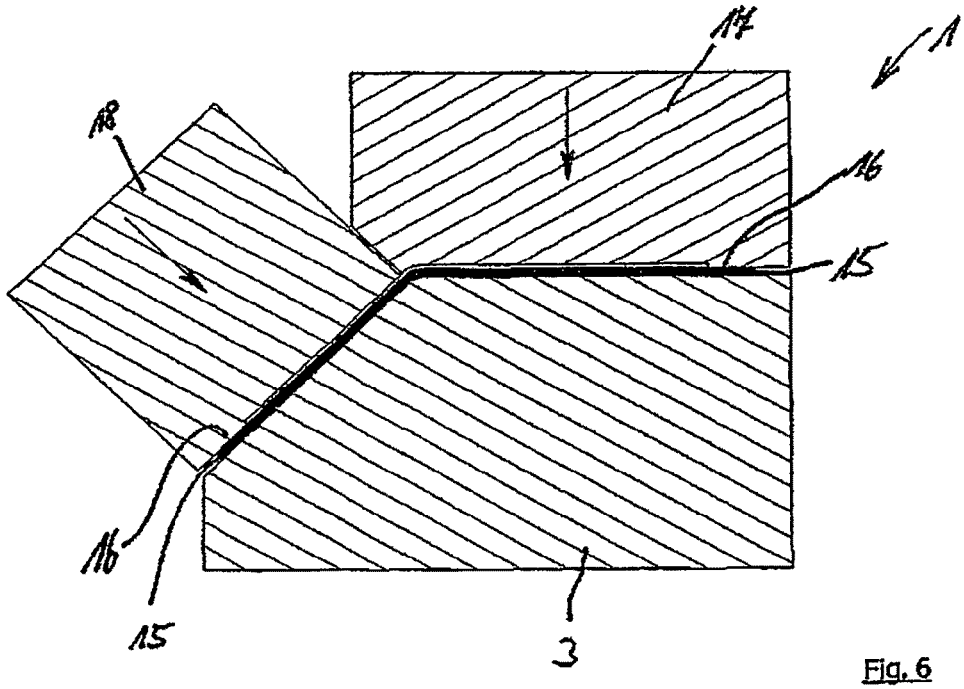
FIG. 6 is a very schematic depiction of die sliders for a die set according to FIG. 5.

In the die, the component (FIGS. 5, 6) is clamped at least in the region of the cut edges (margins). Due to the cooling, the component then attempts to shrink, but is essentially hindered by the clamping and the shape of the die. This generates significant tensile stresses, resulting in the occurrence of plastic deformations in the component. The positive radii (FIG. 10) "support" the component, as a result of which the component rests against the forming dies in the corresponding regions. Due to the shrinkage, the component assumes this form; here, too, imprecisions in the formation of the cold, soft component are corrected. The component is left in the form at least until the austenite/martensite conversion is complete (FIGS. 2, 3). This is definitely the case at approximately 250° C. Then, a linear shrinkage takes place. If the component is removed from the die at approximately 250° C., then it can freely shrink by approximately 0.2% more. If the component is left in the die, then it contracts by approximately 0.2% when removed from the die, which has, however, been taken into account in the initial forming.

Figure 7:
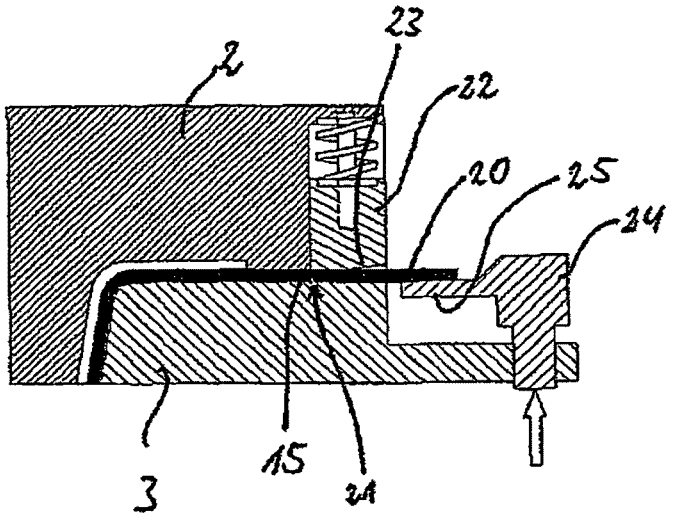
FIG. 7 shows a device for breaking off handling tabs from a processed plate.
Figure 8:
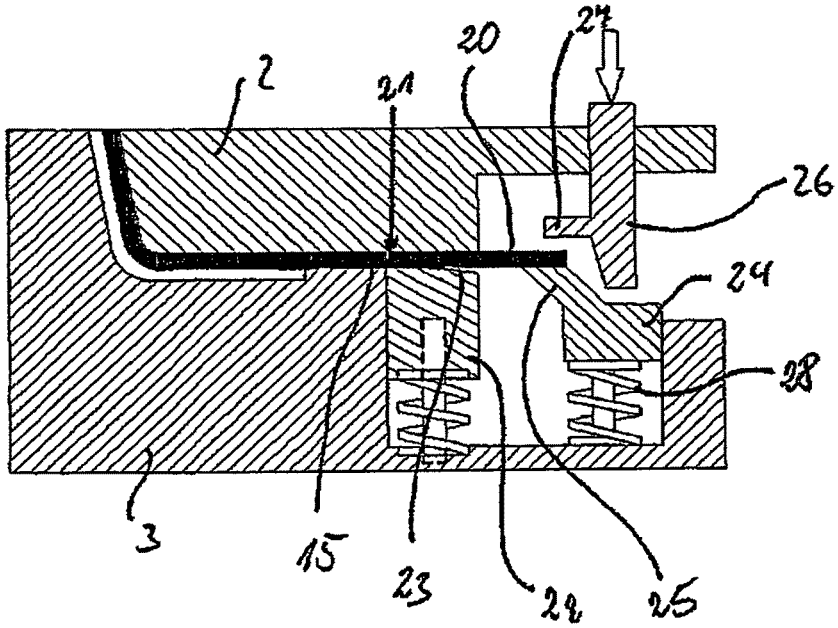
FIG. 8 shows another embodiment of a device according to FIG. 7.
Figure 12:
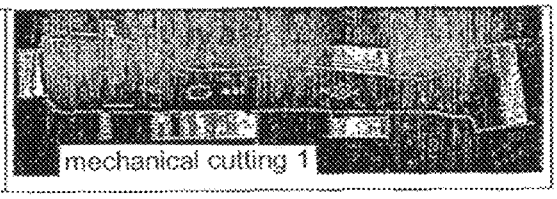
Figure 13:
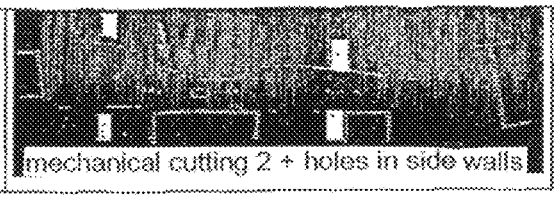
Figure 14:
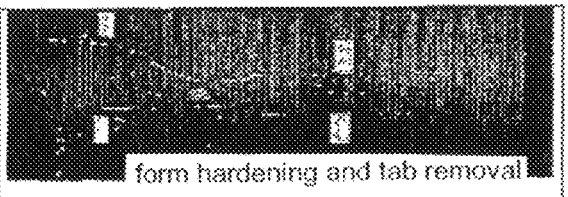
Figure 15:
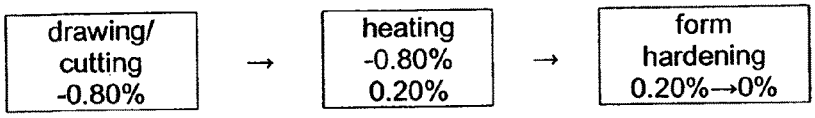
FIG. 15 is a very schematic depiction of the process sequence according to the invention with regard to size changes and the components to be handled.
Figure 16:
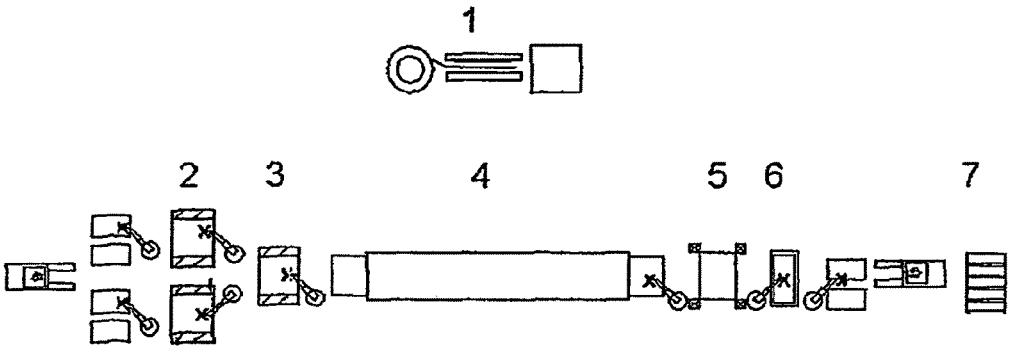
FIG. 16 is a diagrammatic flow sheet of the method according to the invention.

In practice (FIGS. 11 through 14), the production occurs in such a way that first, so-called forming blanks are cut from a sheet. The forming blanks are then formed, in particular deep-drawn (FIG. 12), and then the excess is cut away. Usually, the cutting occurs sequentially so that the entire excess is not cut away in a single step but in two or three steps since otherwise, the trimmed excess cannot be easily removed from the die. In addition, tabs are left on the part (FIG. 14) to permit placement of the part onto so-called part lifters and also to permit the part to be removed from the die by means of these tabs. According to the invention, with simple components, only a single cutting step occurs; in this one cutting step, the tabs are left in place because they are subsequently needed for the insertion into the die (FIGS. 13, 16), then the part is inserted into the die with the tabs (FIGS. 7, 8); in the regions in which the tabs are inserted into the die, notches are produced and then the tabs are hardened along with the entire work piece. Upon removal of the component from the die, pressure elements break off the tabs in the vicinity of the notches so that once removed from the die, the component is completely finished.

A forming die for the method according to the invention will be explained in detail below.

For example, the forming die 1 (FIG. 5) has a forming die top half 2 and a forming die bottom half 3. In the example, the component 4 to be hardened is roughly cup-shaped or hat-shaped in cross-section, with a bottom surface 5, two side walls 6, 7, and two longitudinal flange regions 8, 9. The bottom surface 5 transitions into the side walls 6, 7 at two curves 10, 11. The side walls 6, 7 transition into the flanges 8, 9 at two curves 12, 13. In the vicinity of the curves 10, 11, the die top half 2 constitutes positive radii in relation to the formed part 4; in the vicinity of the curves 12, 13, the die bottom half 3 constitutes positive radii in relation to the work piece 4. In the region of the positive radii, the work piece 4 rests against the respective forming die halves. Opposite from these positive radii, air gaps 14 are provided, which extend into the bottom surface 5 and into the side walls 6, 7. In the region of the middle of the side walls, the air gaps 14 can overlap so that in some regions of the side wall and possibly over almost the entire side wall, the component can have no contact with the die halves. In the region of the cut edges 15, the forming die top half or the forming die bottom half adjacent to the air gaps 14 can be provided with projections or raised areas 16 so that the corresponding regions of the work piece 4 are clamped there.

The air gaps 14 have a width of at least 0.02 mm and preferably from 0.1 to 2.5 mm or greater.

In very simple dies, it can be sufficient in the extreme case to provide a support of the positive radii only, and, exclusively in the region of the curves 10, 11, 12, 13, to provide it in the form of circular segment-like projections and not to support the rest of the work piece, but only to clamp it in the region of the cut edges 15.

In order to achieve a reliable clamping in the region of the side walls or in the region of inflection points or saddle points with narrow radii (approximately 0.5-30 mm) (FIG. 6) without the insertion of the work piece into the form being hindered or having the work piece prematurely come into contact with certain areas of the form, one or more sliding tools 17, 18 can be provided in one of the forming die halves or on opposite sides in both of the forming die halves 2, 3, which sliding tools, preferably during the closing of the die, are moved toward the opposite forming die half or toward each other and, for example, clamp onto holes in the region of the side wall. During the form hardening and shrinkage, this assures a reliable hold even in the region of holes in the sidewalls.

In order to clamp the work piece over its area and length, in particular with linear, rhomboid, or grid-like patterns, the die contains a corresponding pattern in the form of corresponding lines, rhomboids, or grids embodied as a corresponding linear, rhomboid, or grid-like raised area. These lines and these clamping struts are matched to one another so that a reliable clamping can occur. It can be advantageous in this connection to provide such clamping struts on only one side of the work piece, i.e. on one die half, and to assure a full surface contact with the other die half. The high forming pressure by means of the clamping strips makes this easier to achieve than when the goal is a 100% marking image on both die halves. It is also possible, however, to use clamping struts on opposite sides of the work piece from each other. The clamping struts can either be mounted in the die or can be provided in the form of insert elements. According to the invention, such clamping struts are in particular provided at locations in which the work piece must be securely held in order, particularly in components that have a very large surface area or are very long, to avoid a twisting due to thermal stresses or cooling stresses and to avoid distortion. The clamping struts preferably have a width of 5 to 20 mm.

In the vicinity of saddle points, a two-sided, full surface clamping of these relatively small regions is advantageously carried out. Saddle points are defined as points or regions in which two positive radii of two spatial axes of the die coincide and the two positive radii each have a relatively narrow radius of 0.5 to 30 mm.

In the simplest case, however, the component is pressed only in the region of the cut edges and is supported by the respective forming die halves only in the region of the positive radii and does not contact the forming die halves in the remaining regions. In these remaining regions, the component is spaced apart from the forming die halves at least by a small air gap; the width of the air gap can be set as a function of the desired cooling action. In this context, very small air gaps of for example 0.02 to 0.05 mm have hardly any influence on the cooling, whereas very large air gaps of for example 1.00 to 2.5 mm and greater have a considerable influence on the cooling capacity and therefore on the hardness of the material.

In order to break off the above-described tabs, in the vicinity of the longitudinal edge 15, at the location from which a tab 20 protrudes, a notching tool 21 can be provided (FIGS. 7, 8); for example, this notching tool 21 is a protrusion in the region of the die. Opposite from the notching tool, a spring-loaded hold-down device 22 is provided; the spring-loaded hold-down device 22 has a bearing surface 23 that is inclined toward the outside. Opposite from the hold-down device 22 (FIG. 7), the part lifter 24 is provided; the part lifter 24 is equipped with a support projection 25 on which the tab 20 rests. After the hardening is complete, the tab 20 can be lifted by the projection 25 so that with the support of the notching tool 21, it is lifted at an angle against the longitudinal edge in the vicinity of the notching tool 21; in the moment at which the tab 20 comes to rest against the inclined surface 23, the hold-down device 22 can be lifted up counter to the force of the spring. As a result of the high degree of hardness and brittleness, the tab breaks off in the region of the notching tool 21.

In another advantageous embodiment (FIG. 8), the part lifter 24 is situated on the same side of the work piece as the hold-down device 22; the part lifter 24 is likewise supported in a spring-loaded fashion. The notching tool 21 is situated opposite the part lifter 24 and the hold-down device 22. On the opposite side of the work piece from the part lifter 24, a breaking tool 26 that can move back and forth in relation to the part lifter 24 is provided, which can be placed with a lateral protrusion 27 against the tab, bends the tab in relation to the notching tool 21, and breaks it off; the tool 26 rests against the part lifter 24, while the protrusion 25 of the part lifter and the protrusion 27 of the die embrace the tab 20 and with a further movement of the tool 26, the part lifter moves counter to the spring force of a spring 28 until the tab 20 breaks off in the region of the notching tool 21.

This process can be controlled so that the breaking-off occurs at the most advantageous temperature for this to occur.

This measure makes it possible to sharply reduce the total equipment cost. It is thus possible, in particular, to eliminate a cutting step.

In the regions in which the work piece is clamped, however, a cutting operation—for example the production of a hole or recess or the cutting-off of a part of the outside cutting edge in the hot state—can also occur within the clamped region. To this end, the die halves are provided with corresponding recesses in the clamping regions. The hot cutting preferably occurs at component temperatures of between 380° C. and 800° C.

Figure 17:
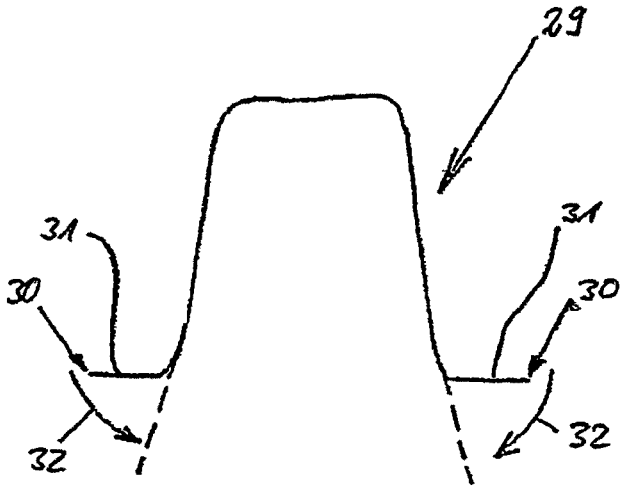
FIG. 17 is a very schematic depiction of a component, which has a cutting flange in the cold-formed state, and also depicts its forming direction.
Figure 18:
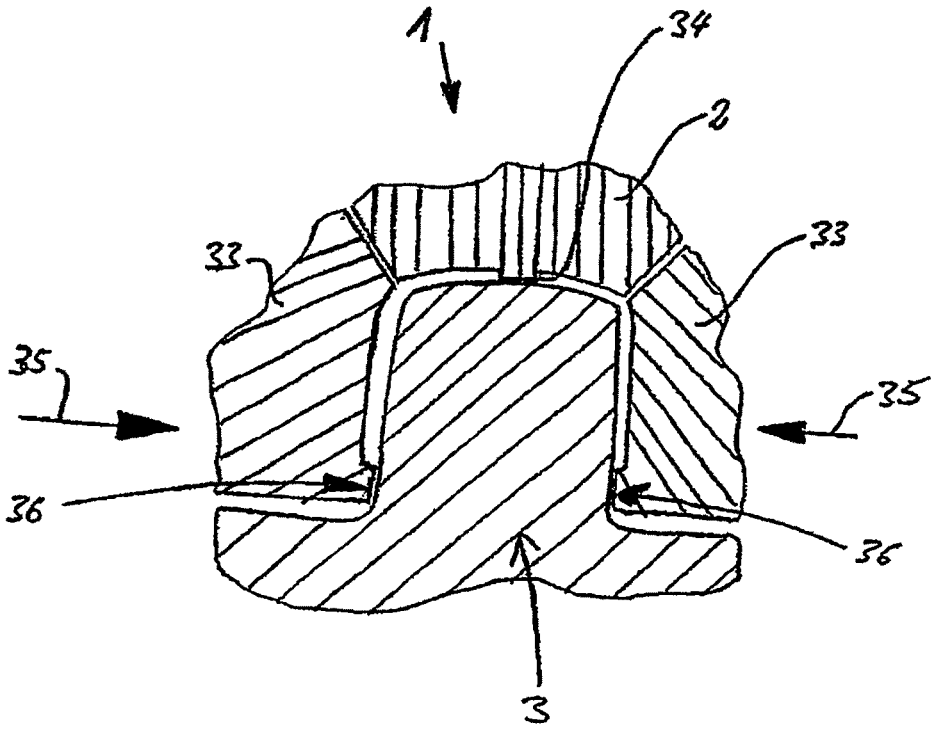
FIG. 18 shows a forming die equipped with two sliders for hot forming a component according to FIG. 17.

In another advantageous embodiment of the method according to the invention (FIGS. 17, 18), during the forming in the cold state, i.e. during the deep-drawing, for example, a flange 31 is produced in an intrinsically known fashion adjacent to the cold-preformed component 29 and in the vicinity of the cut edge 30. After the formation of the flange 31, the outer trimming is carried out in the region of the flange 31. This has the advantage that this cut is produced parallel to the opening and closing direction of the press die. Even in components in which a flange is not actually desired, it can nevertheless be advantageous to produce this flange in the cold state for purposes of the above-mentioned cutting. The flange is then subsequently removed in the course of the form hardening process, as will be described further below.

In this embodiment of the method, an additional hot forming can take place, particularly in the vicinity of the cut edges 30 or the outer contour. As described above, during the final cold forming of the component 29, it can be advantageous to provide the region of the cut edge 30 with a flange 31 whose only purpose is to be cut off and is actually not intended to be part of the finished component 29. The formation of such a flange 31 in the deep-drawing process permits the cut to be produced perpendicular to the opening and closing direction of the die, thus making it possible to execute a particularly exact, precise, and simple cut. During the form hardening process, on the hot component 29, which has been inserted into the die 1, this formed flange is correspondingly reshaped or laid against the die 1 when the die 1 is closed (arrow 32). To this end, in the region occupied by the flange 31, a slider 33 is correspondingly provided; the die 1 for the form hardening process is first closed until the component 29, for example in a particular region 34, is held by the top part 2 of the die and then the sliders 33 are moved inward (arrow 35) and press the flange 31 with correspondingly protruding regions or raised areas 36 against the die 1 or the bottom part 3 of the die on which the component 29 rests. Since the component 29 is clamped anyway in the region of the cut edges 30, the sliders 33 and the areas 36 perform this clamping function in this region; the clamping and the subsequent forced shrinkage surprisingly succeed in achieving this so well that the previously existing bending edge of the flange 31 is practically invisible or undetectable in the finished component.

In an intrinsically equivalent fashion, a flange or deflection can also be produced in the hot state in the vicinity of the cut edges or the outer contour. To this end, a slider exerts a corresponding action on a protruding region of the plate, bends it to the desired degree, and then clamps the flange, the cut edge of the flange, or the bent region, while the remaining region is optionally not clamped, in contradiction to the principal of the forced shrinkage.

As a result, for example, outside the actual regions of the component that are critical with regard to the shape complexity, for example the top of the B column of a vehicle, an additional hot forming can be performed before the forced shrinkage in order, for example, to produce a top flange.

The entire method (FIGS. 16, 17) can occur as follows: 1. Cutting of the blanks, 2. cold forming, for example by means of deep-drawing, then a mechanical cutting step, followed by the heating, form hardening, and then possible cleaning, e.g. an ultrasonic cleaning, and then storage. Since the form hardening dictates the cycle times and there is only one cutting step, it is also possible to forgo the use of the existing, often quite expensive presses and cutting lines equipped with four or five large presses and a slower press can be used, which is set up, for example, on flat ground. Presses of this kind do not have the high clock rates or fast cycle times of large press lines, but these are not needed with the present method. The achievable forming pressures are similar, but the investment costs are significantly lower. In addition, a system for executing the method (FIG. 16) can be constructed in modular form. This means that the system can be rearranged or reconfigured in accordance with a desired production. Since press lines are generally equipped with six presses in a line, but the form hardening process requires a smaller number of presses, a modular design is only possible to a limited degree and furthermore, the unneeded presses cannot be removed.

The present invention has the advantage that the events in a form hardening according to the invention are significantly easier to simulate since the forming does not cause the occurrence of large net expansions over the thickness of the plate. The expansions that occur as a result of forced shrinkage are small.

It is also advantageous that without long break-in times and without the expensive production of prototypes, the invention succeeds in taking relatively imprecise deep-drawn components or components that are easily distorted during forming and, by means of the form hardening, turns them into dimensionally accurate components with a definite hardness and without distortion or twisting. It is also advantageous that relatively inexpensive press lines can be used for the method according to the invention. As a result, the method is significantly less expensive than known press hardening methods.

In an advantageous embodiment, the clamping elements of the forming die halves can be comprised of resiliently supported clamping inserts or clamping strips, which are pressed into the forming dies when the clamping pressure is exerted so that the air gaps are reduced from an initial width and optionally shrink to infinitesimal size.

The invention claimed is:

1. A method for manufacturing hardened components out of sheet steel, comprising:

a) forming formed parts out of a steel sheet;

b) before, during, or after forming the formed part, carrying out an end trimming of the formed part;

c) after end trimming the formed part, heating at least some regions of the formed part to a temperature that permits an austenitization of the steel material; and d) after heating at least some regions of the formed part, transferring the component to a form hardening die, and in the form hardening die the component undergoes a form hardening in which the component is cooled and therefore hardened by virtue of the fact that at least some regions of the component are contacted and pressed by the form hardening die, wherein the component is supported by the form hardening die in the vicinity of a positive radii and at least in some regions and in the vicinity of cut edges, is clamped in a secure manner without distortion; in the regions in which the component is not clamped, the component is spaced apart from at least one forming die half by a gap.

2. The method as recited in claim 1, wherein the component is also clamped in saddle regions, namely regions in which two spatial axes form positive radii, when the saddle regions form relatively narrow radii, in particular of 0.5 to 30 mm.

3. The method as recited in claim 1, wherein the component is also clamped over its area and/or over its length in certain regions in order to achieve a faster cooling rate and/or to reduce stresses and/or to avoid distortion.

4. The method as recited in claim 1, wherein, in addition to the trimmed edges, the component is clamped or held in a distortion-free fashion over parts of its area or over its entire area with a pattern of distributed points and/or an area pattern such as a rhomboid pattern or grid-like pattern with corresponding protrusions of the die halves.

5. The method as recited in claim 1, wherein, in order to achieve the clamping with a pattern distributed over the area, a corresponding pattern distributed in linear and/or punctiform fashion, embodied in the form of a raised area and/or insert clamping lines or insert clamping strips is used in the forming halves.

6. The method as recited in claim 1, wherein the form is adjusted and machined so that outside of the clamped regions, the component is able to freely shrink, as a result of which the component nestles snugly against the die, at least in the vicinity of the positive radii.

7. The method as recited in claim 1, wherein the component is supported only in the vicinity of the positive radii and is clamped in a distortion-free fashion in the regions of the trimmed edges; and in the remaining regions, the forming die halves are spaced apart from the component with gaps.

8. The method as recited in claim 1, wherein the component emerges from the die approximately 0.95%-0.4% smaller in all three spatial axes than the final intended geometry.

9. The method as recited in claim 1, further comprising, after removing the component from the die in a cold state, heating the component is to the austenitizing temperature, in particular to above 900° C., and keeping the component at this temperature until a desired austenitization has occurred.

10. The method as recited in claim 1, wherein the heating of the component is carried out so as to prevent the length change of the material that is brought on by the structural change, which in turn takes place due to the austenitization.

11. The method as recited in claim 1, wherein the nonlinear thermal expansion caused by the austenitization is prevented before the work piece is inserted into the form hardening die.

12. The method as recited in claim 1, wherein, after being clamped in the forming die, the component shrinks; the positive radii are supported, and as a result, the component comes to rest against the forming dies in the corresponding regions; due to the shrinkage, the component assumes the shape of the positive radii; and imprecisions in the forming are corrected in the cold state.

13. The method as recited in claim 1, comprising leaving the component in the die at least until the austenite/martensite conversion is complete.

14. The method as recited in claim 1, comprising heating the component so that in the heated state in the closed form hardening die, it is approximately 0.1% to 0.4% larger than the desired geometry.

15. The method as recited in claim 1, further comprising:

cutting forming blanks from a sheet and then forming the forming blanks in a deep-drawn process;

cutting away the excess in a cutting operation, leaving tabs on the component to permit the part to be placed onto part lifters of the forming die halves;

hardening the tabs in the form along with the component;

producing notches in the vicinity of the region in which the tabs adjoin the component; and before removing the component from the die, breaking off the tabs by bending.

16. The method as recited in claim 1, wherein air gaps are set to a width of at least 0.02 mm.

17. The method as recited in claim 1, wherein, during the hardening, the air gaps are flushed with gas.

18. The method as recited in claim 1, wherein, when removed from the form hardening die, the component uniformly assumes the final geometry.

19. The method as recited in claim 1, wherein, in the regions in which the component is clamped, the production of a hole or recess inside the sheet is carried out within the clamped region or the cutting-off of a part of the outer contour or the entire outer contour is carried out in the hot state.

20. The method as recited in claim 1, wherein during the form hardening, a hot forming occurs to the effect that flanges produced during the preceding cold forming, or desired new flanges or deflections produced by sliders situated in the die are bent, produced, or bent toward or pressed against the forming die halves in which the work piece is contained, and the cut edges are held there in a clamped fashion.

21. The method as recited in claim 1, further comprising:

before, during, or after forming the formed part, carrying out punching operations or the production of a hole pattern.

* * * * *